US008919600B2

(12) United States Patent
Ferry

(10) Patent No.: US 8,919,600 B2
(45) Date of Patent: Dec. 30, 2014

(54) PLASTIC FLANGED CONTAINERS AND FOOD PRODUCT PACK COMPRISING SUCH CONTAINERS

(75) Inventor: Vincent Ferry, Paris (FR)

(73) Assignee: Compagnie Gervais Danone, Paris (FR)

( * ) Notice: Subject to any disclaimer, the term of this patent is extended or adjusted under 35 U.S.C. 154(b) by 230 days.

(21) Appl. No.: 13/440,835

(22) Filed: Apr. 5, 2012

(65) Prior Publication Data

US 2012/0251679 A1 Oct. 4, 2012

Related U.S. Application Data

(63) Continuation-in-part of application No. PCT/IB2011/000797, filed on Mar. 15, 2011.

(51) Int. Cl.

| | |
|---|---|
| ***B65D 6/00*** | (2006.01) |
| ***B65D 1/40*** | (2006.01) |
| ***B65D 85/76*** | (2006.01) |
| ***B65D 85/72*** | (2006.01) |
| ***B65D 1/26*** | (2006.01) |

(52) U.S. Cl.
CPC *B65D 85/72* (2013.01); *B65D 1/26* (2013.01); *G65D 1/30* (2013.01)
USPC ..... 220/675; 220/62.13; 426/130

(58) Field of Classification Search
CPC ..... B65D 1/26; B65D 1/40; B65D 1/30; B65D 85/72
USPC ..... 220/62.22, 604, 608, 62.13, 641, 660, 220/23.4, 675, 359.2, 359.3, 574, 359.1; 426/130, 123, 108; 215/12.1
See application file for complete search history.

(56) References Cited

U.S. PATENT DOCUMENTS 3,128,005 A * 4/1964 Sherlock ..... 220/288
4,058,630 A 11/1977 Busnel (Continued)

FOREIGN PATENT DOCUMENTS

CH 683610 A5 4/1994
DE 8215902 U1 10/1982

(Continued)

OTHER PUBLICATIONS

International Search Report and Written Opinion from International Application No. PCT/IB2011/000797 dated Oct. 19, 2011.

*Primary Examiner* — Bryon Gehman
*Assistant Examiner* — Shawn M Braden
(74) *Attorney, Agent, or Firm* — Greenberg Traurig, LLP

(57) ABSTRACT

The flanged container for a dairy product or similar food composition is provided with a hollow body and a generally planar annular flange connected to the top of the body, the flange having outer straight side edges and an inner edge defining a circular upper opening of the container. The body has a planar bottom and a lower portion tapering from a generally cylindrical upper portion toward the bottom in a curved manner. The lower portion has a height h1 in some embodiments not less than 14 mm and the ratio h1/H is less than 2:5 where H is the height of the container. The side wall of the body has a thickness profile such that the average thickness of the lower portion is more than the average thickness of the upper portion. Several identical containers can be grouped in a pack with breakable junctions at the outer straight side edges.

82 Claims, 7 Drawing Sheets

(56) References Cited

U.S. PATENT DOCUMENTS

| | | | | |
|---|---|---|---|---|
| 4,446,969 | A * | 5/1984 | Tyler | 206/519 |
| 4,685,273 | A * | 8/1987 | Caner et al. | 53/440 |
| 5,052,553 | A * | 10/1991 | De Sanctis | 206/219 |
| 5,676,267 | A * | 10/1997 | Slat et al. | 215/12.1 |
| 5,782,376 | A * | 7/1998 | Brauner et al. | 220/669 |
| 2007/0134381 | A1 * | 6/2007 | Socher | 426/383 |
| 2008/0296196 | A1 * | 12/2008 | Duffield et al. | 206/524.7 |

FOREIGN PATENT DOCUMENTS

| | | | |
|---|---|---|---|
| DE | 8619012 | U1 | 3/1988 |
| FR | 2291111 | A1 | 6/1976 |
| FR | 2432975 | A1 | 3/1980 |
| FR | 2533891 | A1 | 4/1984 |
| FR | 2595658 | A1 | 9/1987 |
| WO | 97/02187 | A1 | 1/1997 |

* cited by examiner

FIG. 1
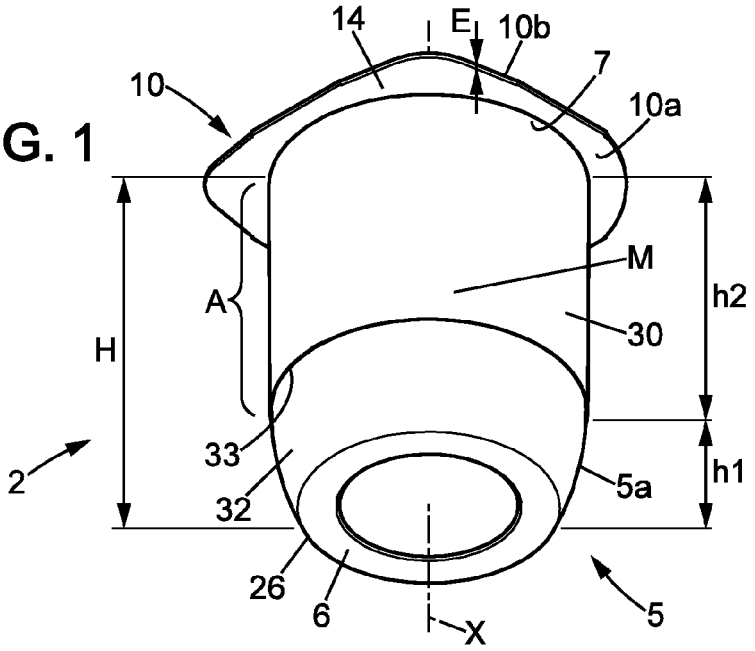
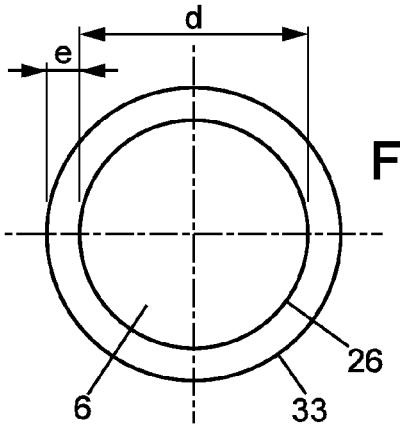
FIG. 2A
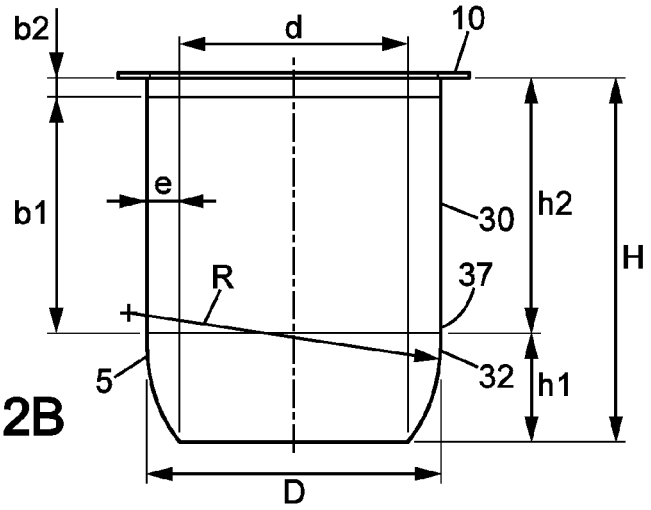
FIG. 2B

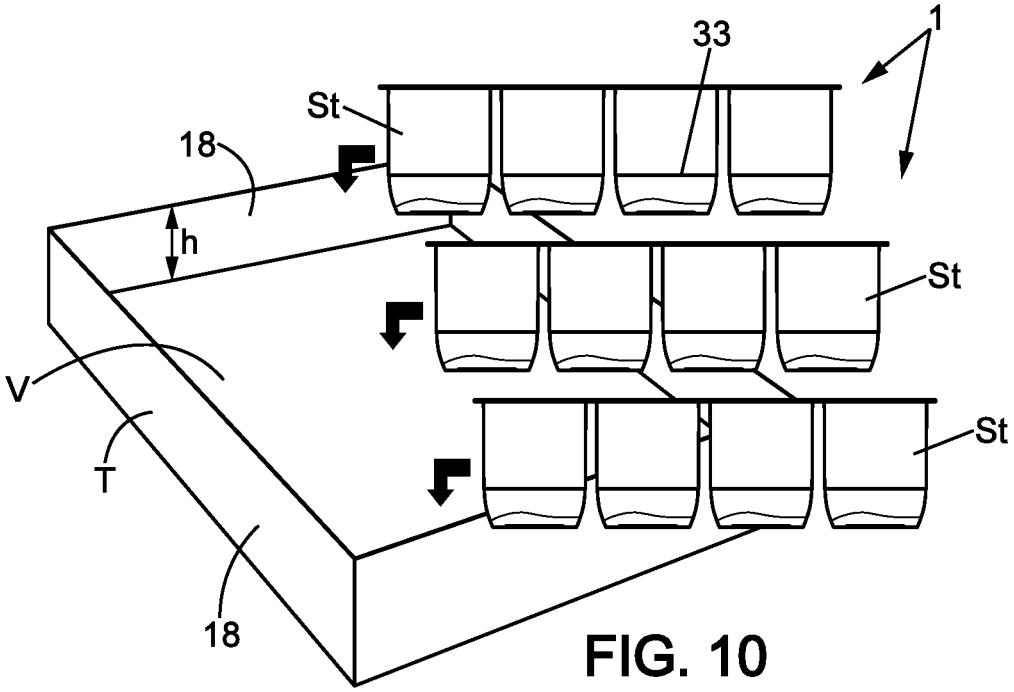
FIG. 10
FIG. 11
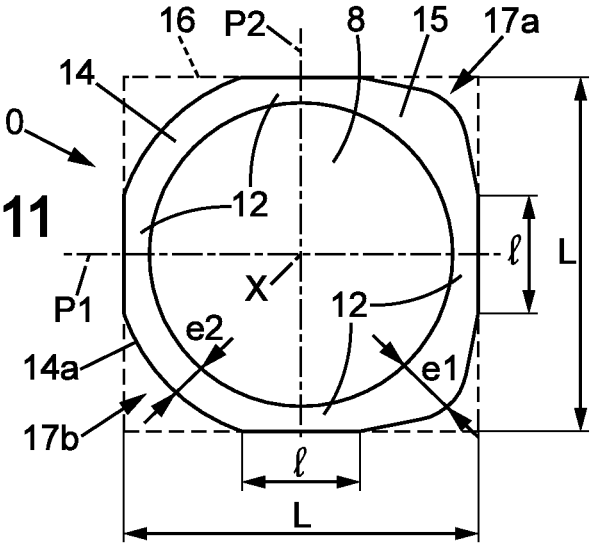

PLASTIC FLANGED CONTAINERS AND FOOD PRODUCT PACK COMPRISING SUCH CONTAINERS

RELATED APPLICATIONS

This is a continuation-in-part of pending International Application PCT/IB2011/000797, with an international filing date of Mar. 15, 2011, which is hereby incorporated by reference herein in its entirety for all purposes.

FIELD OF THE INVENTION

The present invention generally relates to containers used in food packaging industry, particularly to thermoformed plastic flanged containers, such as yoghurt pots or similar. The invention also concerns a pack comprising such flanged containers.

BACKGROUND OF THE INVENTION

It is known to produce a container provided with a body and a generally planar annular flange integral with the body, and in particular a yoghurt pot or similar, by means thermoforming a sheet of plastic to form the volume. Typically, the plastic sheet is heated and then drawn into a cavity such as by vacuum and/or pressure. As the sheet is drawn into the cavity, the thickness of the portion of the sheet drawn into the cavity is reduced as the sheet material is stretched into the cavity. With such a method, the side wall of the body is thin, while the flange has the same thickness and the same rigidity as the original sheet of plastic. As the flange is thin and planar, the body essentially defines the height of the container.

Regarding the forming of the body, the thickness of the sheet material can be reduced when increasing the depth of the cavity. It can be appreciated that problems may occur where the plastic material rapidly changes angles in the volume such as at the bottom and sidewall of a cup-shaped container. It is thus not recommended having a too thin side wall for the purpose of sustaining the rigors of distribution.

The plastic containers are conventionally sealed with membranes and can be manufactured and sold in a multiple portion packaging tray comprising an array of separable containers. After separation, each container flange still has four outer side edges so as to keep integrity of the content. These containers work well when made of relatively brittle plastic. Use of less brittle or more pliable polymers makes the containers more difficult to break apart. Such a difficulty may cause escape of the content when breaking other parts of the container.

In food packaging industry, the plastic containers can be stacked on top of one another so as to form stacks which can be layered on a pallet. A loading weight on a pallet may be much more than 500 kg. Such stacks allow the packaging items at the bottom to withstand the compressive load of the packaging items on top. The plastic containers layers are typically stored in cardboard trays each having a bottom and side walls preventing lateral tilting of the layers.

There are already some solutions to provide to the consumers containers with less plastic material. For instance, the French patent FR 2 432 975 describes plastic containers with polygonal flanges, V-cuts being provided to recycle material of the flanges.

However, the weight of the plastic containers cannot be easily reduced since the containers made of relatively brittle plastic have to be transported in a safe manner and without any deformation. The packs of containers have to be sufficiently robust in particular for transportation on a pallet. It is also preferably required that the containers are user-friendly, i.e. not complicating user's operations such as separating an individual container, opening the membrane seal, eating the content.

The plastic containers of this type are typically produced in very large quantities and may be each covered by a decorative strip or band (also called banderol). Decorative strips are very commonly used for packagings containing dairy products such as for example yoghurts or butter but also products such as stewed fruit or margarine. Such a decorative strip is aesthetically advantageous and may contain a lot of useful information. Moreover such a decorative strip contributes to strengthening the container. In order to reduce the total weight of the packaging, a need exists for reducing the amount of material in the decorative strip. More generally, it is important as far as possible to reduce the unit cost of each packaging but without impairing its strength and its aesthetic characteristics.

Containers having a lower portion tapering toward the bottom in a curved manner are believed to have a visually distinctive shape that is appreciated by consumers. However such lower portions provide a low resistance to top compression and some deformation can occur. There is a need for containers that have a curved lower portion with an improved resistance and/or with a reduced amount of material.

SUMMARY OF THE INVENTION

The purpose of the present invention is to provide flanged containers using less material, typically less plastic material or less decorative strip material, (for the same volume of food product) while at the same time having a comparable or higher mechanical properties and addressing one or more of the above mentioned problems.

To this end, embodiments of the present invention provide container for a food composition, comprising:

- a thermoplastic hollow body comprising a generally planar bottom and a side wall extending along a longitudinal axis from said bottom as far as a top, and
- a generally planar annular flange integral with the body and connected to the top of the body, the flange comprising an inner edge defining a generally circular upper opening of the container, wherein:

- the body comprises a side wall having a generally cylindrical upper portion having a height h2, that comprises the top of the body and a lower portion having a height h1, tapering from the upper portion toward the bottom in a curved manner, the upper portion and the lower portion intersecting and interconnecting at a peripheral intersection line,
- the upper portion of the side wall is optionally covered by a decorative strip having a height not more than the height h2 of the upper portion,
- the container has a height H defined between the planar bottom and the flange,
- the peripheral intersection line is spaced and at a substantially constant distance from the planar bottom, the lower portion having a height h1 corresponding to a minoritary fraction of the height H of the container, and
- the side wall has a thickness profile such that the average thickness of the lower portion is more than the average thickness of the upper portion.

Of course, the wording "thickness profile", here for a side wall of substantially circular cross section, should be understood as the profile of thickness with respect to the longitudinal dimension (i.e. with respect to the height measured from the container base defined by the planar bottom).

The generally circular upper opening has an inner diameter which is less than the height H of the container.

With such a lower portion, a soft transition is obtained between the substantially vertical upper portion and the planar bottom. It can be appreciated that the curved shape of the tapered lower portion represents a thicker convex structure whose resistance to vertical and/or transversal loads is optimized, thus making it possible, for a given volume and a given amount of material, to achieve mechanical properties which are better than the cylindrical or roughly cylindrical shapes customarily encountered in this domain. Meanwhile the upper portion represents a thinner straight structure providing surprisingly optimized use of materials, optionally with the decorative strip.

In an embodiment, the lower portion has a thickness which is more than an intermediate thickness of the body at a junction between the lower portion and the upper portion, the upper portion having a thickness less than the intermediate thickness at a distance from the top of the body.

Furthermore, use of a body having a circular opening allows a good compromise for accessibility to the content without increasing radial dimension(s) of the container. As the body is deeper that wide, this also advantageously minimizes the radial bulk of the containers that may be easily grouped in a compact pack.

It is understood that the cylindrical upper portion of the body can be covered by a conventional decorative strip. The height of the upper portion defining an upper area for the decorative strip is advantageously reduced, thus saving packaging material. Surprisingly, the decorative strip St of reduced size is better integrated when combining a circular cross section of the body and such a tapered lower portion than when using another kind of shape for the body. In contrast, with a shorter decorative strip St partially covering a conventional tubular wall extending from the flange to the bottom with a substantially constant cross-section, the final consumer will immediately think that the decorative strip St has not the expected size. As a result, this could be interpreted as a problem with the packaging and the consumer could be dissuaded to buy the product.

According to a particular feature, the following relations are satisfied:

$$0.14 \leq h1/H \leq 0.4$$

$$0.6 \leq h2/H \leq 0.86$$

where h1 is the height (constant height) of the lower portion, h2 is the height (constant height) of the upper portion and H is the height (constant height) of the container. In an embodiment, the ratio h2/H is comprised between 2:3 and 4:5. In another embodiment, this ratio is less than or equal to 3:4. Accordingly, it is advantageously obtained a sufficient upper area that can be covered by a conventional decorative strip (using for instance a conventional process to fix the rectangular strip onto the cylindrical upper portion) and a lower portion having a significant height to obtain a better transition toward the outer edge of the bottom and thus increase the mechanical properties.

According to another feature, the lower portion is continuously rounded from said bottom as far as said intersection line. Accordingly, the resistance is increased and the lower end of container is bowl-shaped to facilitate retrieving of the whole content when using a spoon. In some embodiments, in a cross section, a "large" radius R is used to establish a circular or almost circular arc that extends from the peripheral intersection line as far as the outer edge of the planar bottom. Such an arc is not tangent to the planar endwall surface of the bottom but significantly increases the angle at the junction with the bottom (an angle about 120° may be obtained for instance).

According to another feature, the lower portion has a shape corresponding to a circumferential portion of a virtual prolate spheroid that extends along the longitudinal axis, the circumferential portion defined between two parallels of the virtual prolate spheroid, the two parallels having each a circular shape with one of the parallels corresponding to said intersection line and the other parallel corresponding to an outer edge of said planar bottom. In an embodiment, one or two of the following relations are satisfied:

$$0.2 \leq h1/H \leq 0.32 \text{ or } 0.25 \leq h1/H \leq 0.30,$$

$$0.78 \leq d/D \leq 0.9 \text{ or } 0.81 \leq d/D \leq 0.84$$

where d is the diameter of the outer edge of the planar bottom and D is the outer diameter of the intersection line.

With such a configuration, the transition between the intersection line and the outer edge of the bottom is significant and the mechanical properties may be improved without impairing the aesthetic of the container. In particular, the upper portion can be covered with a decorative strip having a height sufficient for displaying useful information about the food product. In an embodiment, the height of the decorative strip is not more than the height of the upper portion.

According to another feature, at an intersection between the lower portion and a median virtual plane of the body perpendicular to the bottom, a rounded arc is defined with a radius of curvature R, the height h1 of the lower portion being such that the ratio R/h1 is comprised between 2 and 2.8. The radius of curvature is thus large and the thickness needs not be too high in this lower portion due to this large radius of curvature. The height h1 is typically more than or equal to 14 mm.

In various embodiments of the flanged container of the invention, recourse may optionally also be had to one or more of the following dispositions:

- the upper portion of the body has a determined wall thickness of less than 280 μm, and typically comprised between 110 and 160 μm, substantially in the middle of the body, the lower portion having a wall thickness more than said determined wall thickness (the upper portion thus may be particularly thin without impairing the general resistance of the container, especially when reinforced by a decorative strip).
- the lower portion has a thickness comprised between 150 and 300 μm.
- the side wall has a thickness profile with an increase of thickness toward the bottom, the lower portion having a maximum of thickness less than 220 μm, the determined wall thickness of the upper portion being not more than 160 μm substantially in the middle of the body.
- the opening is circular, the planar bottom having a continuously rounded outer edge.
- the body has a circular section in cross-section and extends symmetrically around said longitudinal axis, the bottom having a periphery of circular shape.
- the lower portion defines a first outer surface of the body and the bottom defines a second outer surface of the body, the ratio between the first outer surface and the second outer surface being comprised between 5:2 and 5:3 (with such an arrangement, stability of the container is relatively high and the lower portion is particularly suitable for preventing damages in the lower part of the container during transport).

the upper portion of the body determines an imaginary tube extending longitudinally around said longitudinal axis, wherein the bottom has a rounded outer edge that is radially spaced apart from the imaginary tube to define a substantially constant radial distance e between said rounded outer edge and the imaginary tube, and wherein the height h1 of the lower portion is such that the ratio e/h1 is comprised between 1/6 and 1/3. In a typical embodiment, this ratio e/h1 is comprised between 1/5 and 3/10.

in a median virtual plane that is perpendicular to the bottom, an angle comprised between 2° and 10° is formed at the intersection line between the lower portion and the upper portion; in other words, the arc defined in the lower portion is not tangent to the cylindrical surface of the upper portion, which is advantageous to increase the radial distance e while keeping a large radius of curvature.

the lower portion is provided with a mark that is formed when forming the body.

the flange comprises a lower face and an upper face, the container comprising a membrane seal that is fixed to the upper face of the flange, the membrane seal sealing the opening and covering entirely said upper face of the flange.

the body of the container defines a cavity filled with a dairy product; in particular the dairy product may be a yoghurt composition having a weight not less than 50 g and not more than 500 g.

the flange comprises at least three outer straight side edges, the outer straight side edges comprising two parallel outer straight side edges and at least one outer straight side edge perpendicular to the two parallel outer straight side edges, and wherein when four of said first flange portions are provided on the flange, four corresponding outer straight side edges are provided and define a virtual square.

A further purpose of the invention is to provide a food pack easy to be manipulated in a supermarket (before exposure of the containers by the operators and thereafter by the final consumer) and resistant while reducing amount of plastic material.

To this end, embodiments of the present invention provide a food pack comprising a plurality of containers according to the invention arranged in at least one row, and typically at least four containers arranged in two rows, the flanges of the pack being integrally formed and separably joined to each other at a junction between two of the first flange portions of two distinct containers of the pack.

Accordingly, there is provided a pack, which is particularly well adapted for transportation in a stackable tray, while limiting the amount of material.

Two of the second flange portions may be advantageously rounded and define external portions of the pack. These two second flange portions are adjacent corner portions separated by one of the first flange portions. This geometry is user-friendly (without sharp edges).

According to a particular feature, the flanges have an identical shape in all the containers of the pack. The pack may comprise a group of four containers provided with a star-cut pattern between the individual containers, said star-cut pattern having a length L1, such that the following relation is observed:

$$0.75 \leq L1/D_{int} \leq 0.95$$

where $D_{int}$ is the diameter h the circular opening.

Accordingly, the material saved by the larger cut at the central region may be re-used for other packs, for example by recycling. It should be noted that the flanges may have a constant thickness, this thickness being provided at the junction. Here, tearing the separation region for removal of an individual container is not facilitated by a reduction of thickness, the shorter length of the outer straight side edges being sufficient to make the removal easy for the user.

It is also provided, according to the invention, a use of a container according to the invention for containing a dairy product such as a yoghurt composition having a weight not less than 50 g and not more than 500 g, typically not less than 75 or 80 g and not more than 400 g, and in a embodiment not less than 100 g and not more than 200 g. In an embodiment, a yoghurt composition has a weight comprised between 100 and 200 g. The shape of the opening and the flange are particularly user-friendly while the arrangement of the body is very compact when containing a yoghurt composition or similar dairy product having a weight comprised between 100 and 150 g. In another embodiment, the weight is about 125 g.

Other features and advantages of the invention will become apparent to those skilled in the art during the description which will follow, given by way of a non-limiting example, with reference to the appended drawings.

BRIEF DESCRIPTION OF THE DRAWINGS

FIG. 1 is a perspective view showing an individual container according to an embodiment of the invention;

FIGS. 2A and 2B are respectively a top view and a cut view according to a longitudinal plane of an individual container according to another embodiment of the invention;

FIG. 10 is a schematic view showing a stackable tray and arrays of containers according to an embodiment;

FIG. 11 shows a top view of an open individual container according to an embodiment;

DETAILED DESCRIPTION OF EMBODIMENTS

Figure 3:
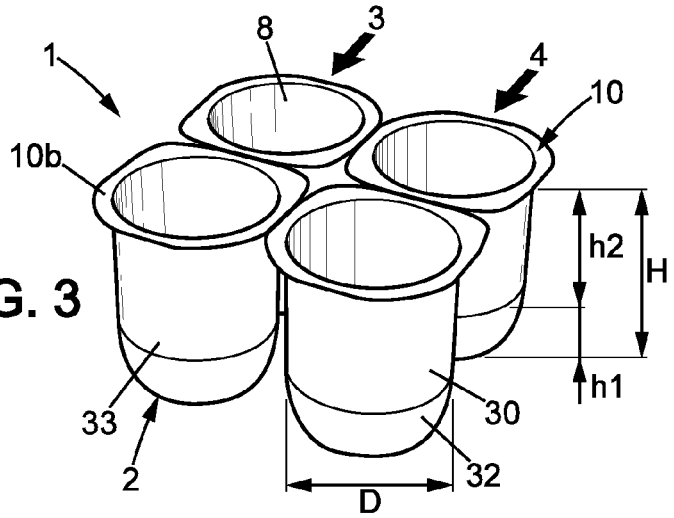
FIG. 3 is a perspective view of a food pack including open containers as shown in FIGS. 2A-2B.

In the various figures, the same references are used to designate identical or similar elements.

FIGS. 3, 4, 5 and 9 show a food pack 1 comprising for instance four individual containers 2. Of course the number of containers 2 may vary and a number of 2, 6, 8, or 12 containers 2 may be provided, in a non-limitative example. In one embodiment, the containers 2 are arranged in at least one row. In another embodiment, the containers are arranged in at least in two rows 3, 4 when the pack 1 comprises four or more containers 2.

Referring to FIGS. 1, 2A and 2B, the containers 2 of one embodiment are polystyrene containers, each comprising a hollow body 5 having a side wall extending along a longitudinal axis X from a bottom 6 as far as an open top 7. The side wall 5*a* of the body 5 is tubular and is adapted to be covered by a cylindrical decorative strip St, sticker or banderol in the upper area A adjacent to the upper body opening, called hereafter circular opening 8. It is understood that the longitudinal axis X is here a central axis for the body 5 and the opening 8. Fixing of the strip St is performed in a known manner.

More generally, the container 2 can be made of any suitable thermoplastic material, possibly with at least one additional layer. The hollow body 5 can be stretched with a stretching ratio comprised between 5 and 7. The container 2 comprises a generally planar annular flange 10 integral with the body 5 and connected to the top 7 of the body 5. The flange 10 has not been stretched.

As shown in FIGS. 3, 4, 5 and 9, the flange 10 radially extends between an inner edge 10*c* that defines the generally circular upper opening 8 and an outer edge 10*d* that defines the perimeter of the flange 10. The side wall 5*a* of the body 5 has a cylindrical upper portion 30 directly connected to the flange 10 and a lower portion 32 tapering from the upper portion 30 toward the bottom 6, in a curved manner as clearly apparent in the FIGS. 1 and 2B.

It can be seen that the upper portion 30 and the lower portion 32 intersect and interconnect at a peripheral intersection line 33 that is here circular.

Between the substantially circular junction with the flange 10 and the also substantially circular intersection line 33, the upper area A defines a generally cylindrical surface for receiving the strip St. The strip St may be added by an in-mold labelling method or the like. A small step or shoulder appropriate for maintaining the decorative strip can be present or absent on the side wall 5*a* at the peripheral intersection line 33. Such a step does not protrude more than about 0.5 mm from the cylindrical surface defined by the upper portion 30.

The peripheral intersection line 33 is spaced and at a substantially constant distance from the planar bottom 6 as apparent in FIG. 2B and the height h1 of the lower portion 32 corresponds to a minority fraction of the height H of the container 2. It can be appreciated that the height H of the container 2 is larger than the larger size of the body 5. In some embodiments, the height h2 of the upper portion 30 is not significantly larger than the outer diameter D of the cylindrical upper portion 30 and may be less than this outer diameter D as in the examples of FIGS. 1, 2B and 6 for instance. According to any point of view around the container 2, the upper area A can be seen as close to a squared shape, the height h2 of the upper portion 30 being slightly less (from max. 15%), equal or not exceeding from more than 10-15% the inner diameter $D_{int}$ of the opening 8 and/or the outer diameter D or similar apparent width of the body 5. With such an arrangement, the upper portion 30 is particularly useful for displaying information and is typically covered by a rectangular shaped strip St arranged in a form of a sleeve label.

Accordingly, the body 5 is higher than wide essentially because of the significant height h1 of the lower portion 32. As this height h1 is significant and typically comprised between 14 and 24 mm (the height H being not more than about 65 or 75 mm), the rounded aspect near the bottom 6 is clearly apparent. The lower portion 32 is here continuously rounded from the bottom 6 as far as the peripheral intersection line 33.

The height h2 of the upper portion 30 (the height h2 is equals H minus h1), which is here constant, may represent a fraction of the height H at least equal to 0.6 and not more than 0.86. The height h1 of the lower portion 32 is thus less than a fraction of about ⅖ of the height H. The ratio h1/H is thus comprised between 0.14 and 0.4. A ratio h2/H comprised between 2:3 and 4:5 in some embodiments. In some embodiments, the ratio h2/H is less than or equal to 3:4. As a result, the rounding of the lower portion 32 is obtained with a soft transition, i.e. with a large radius of curvature R and the mechanical properties near the bottom 6 are good without having any specific increase of thickness in the area adjacent the bottom 6. As a way of specific examples, a ratio h1/H of 0.25-0.27 or 0.27-0.29 or 0.29-0.31 may be used. In some embodiments, a ratio h1/H more than 0.2 has a less pronounced angle at the junction between the lower portion 32 and the bottom 6. In some embodiments, the ratio h1/H is not more than 0.32 to have a sufficient upper area A. Furthermore, it is advantageous having a relatively large upper area A at least because the reduction of thickness is here essentially obtained in the upper portion 30 of the body 5.

A ratio h1/H of about 0.30 is used in the FIGS. 1, 2B, 3 and 6. A greater ratio h1/H is used in FIG. 5 which shows a container 2 having typically a height H comprised between 55 and 88 mm. Here the ratio h1/H is about 0.4-0.45 and the lower portion 32 has a minority outer surface S1 as compared with the upper area A. Embodiments with a ratio h1/H comprised between 0.25 and 0.4, and other embodiments with a ratio h1/H comprised between 0.32 and 0.4 may be used if high mechanical properties are required and saving of strip material is considered as more important than saving of plastic material of the raw container 2.

Figure 6:
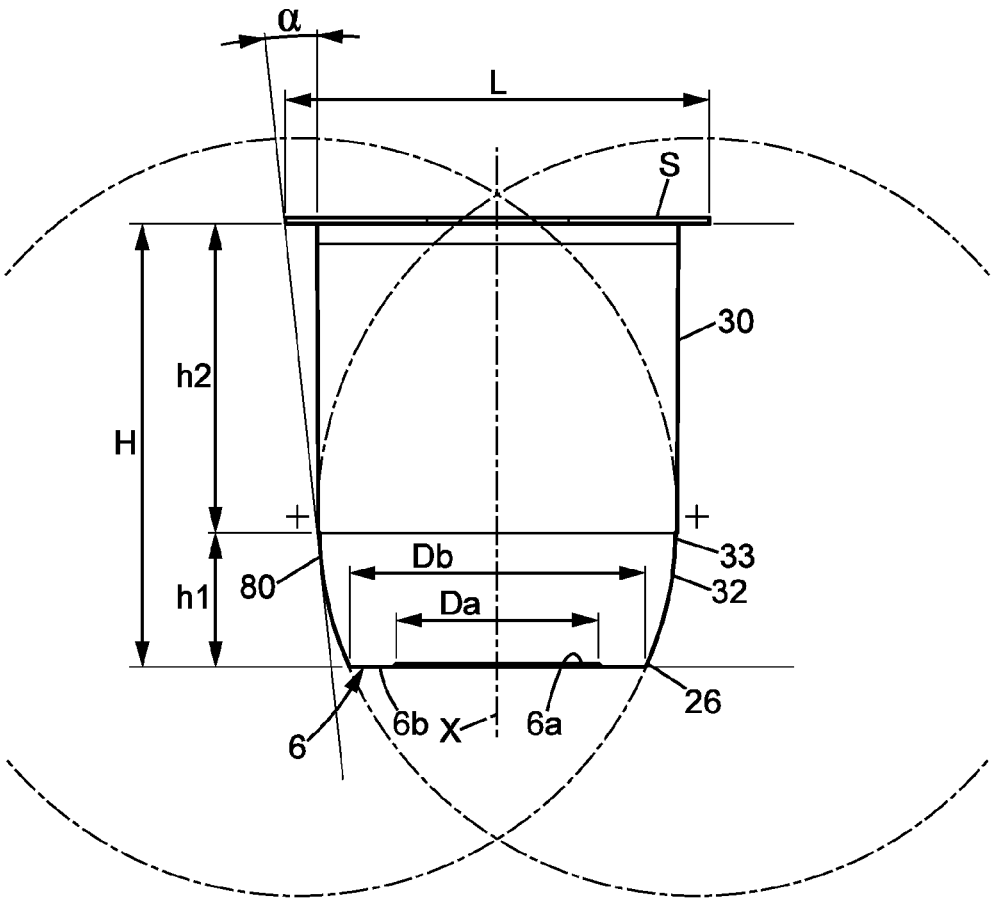
FIG. 6 is a sectional view similar to FIG. 2B showing the container of FIG. 1.

In a first embodiment as shown in FIGS. 1 and 6 in particular, the bottom 6 may be provided with a recess or cavity 6*a* with a concavity oriented to the exterior. The annular portion 6*b* of the bottom 6, defined around the cavity 6*a*, has a diameter Db less than the diameter $D_{int}$ of the circular opening 8 defined at the top 7 of the body 5. The diameter Da of the cavity 6*a* may be comprised between one half and two thirds of the diameter $D_{int}$ of the circular opening 8. The bottom 6 provided with the cavity 6*a* has a better strength for better supporting a compression load. Of course, the bottom 6 may still be considered as a generally planar bottom 6, at least because the bottom 6 has a flat shape and the container 2 is adapted to be maintained vertically when the bottom 6 is in contact with a horizontal base support (the longitudinal axis X being vertical). Of course, the height of the cavity 6*a* in some embodiments is very small, for instance about 0.5 mm.

In the second embodiment as shown in FIG. 2B, the bottom 6 may be planar. Here, the body 5 is more high than wide as in the first embodiment. This is advantageous to form packs 1 of several containers 2 that can be easy stored during transport and on supermarket shelves.

Referring to FIGS. 1 and 6, the polystyrene used in the container 2 has thickness E of about 0.85 or 0.9 mm in the flange 10 and a lower thickness in the body 5. The thickness may vary depending upon the food packaging application and may be chosen in the range 0.5-1.5 mm, the thickness of some embodiments being less than 1 mm and more than 0.7 mm with some embodiments comprising the range 0.8-0.9 mm. Thicker materials may be used for heavier food products. A film called thereafter a membrane seal S is used to cover the containers 2. Such a membrane seal S may be a plastic film made from plastic resin or a foil film. An adhesive may be used to seal the film to the upper face 10*b* of the flange 10. The membrane seal S entirely covers this upper face 10*b*.

In some embodiments, the thickness of the upper portion 30 at a distance from the top 7 is comprised between 0.10 mm and 0.20 mm (and may be slightly less than 0.20 mm in the area adjacent to the junction 37 with the lower portion 32). Substantially in the middle M of the hollow body 5, the thickness of the upper portion 30 in some embodiments is less than 0.16 mm and more than or equal to 0.11 mm. The wording "substantially in the middle of the body" is conventionally used for thin-walled containers and is to be understood as meaning at about a half height of the body 5 and more generally in a middle part of the body that may represent about 50% of the total height of the body. The thickness of the lower portion 32 is comprised between 0.14 or 0.15 mm and 0.30 mm.

More generally, the upper portion 30 of the body 5 has a determined wall thickness in the middle M of the body 5 less than one fifth in some embodiments and in other embodiments, less than one sixth of the thickness E in the flange 10. It will be understood that the thickness of the upper portion 30 may locally increase at the top 7 with the connection to the flange 10. The determined wall thickness of the upper portion 30 is typically of less than 0.25 mm substantially in the middle M of the body 5. The wall thickness of the lower portion 32 is here more than the determined wall thickness of the upper portion 30. In the bottom 6, the thickness may be equal to the thickness of the lower portion 32. More generally, the bottom 6 has a thickness comprised between 140 and 300 μm.

EXAMPLE 1

In Example 1, multiple cups with varying thickness profiles as shown in Table 1 were tested to identify the portion of the cup that ruptured when the top of each cup was subjected to a load.

TABLE 1

| Body | Height from base (mm) | Cup 1 Sheet thickness (mm) | Cup 2 Sheet thickness (mm) | Cup 3 Sheet thickness (mm) | Cup 4 Sheet thickness (mm) |
|---|---|---|---|---|---|
| Lower portion | 0 | 0.15 | 0.13 | 0.17 | 0.21 |
| | 5 | 0.15 | 0.14 | 0.19 | 0.22 |
| | 10 | 0.15 | 0.13 | 0.18 | 0.21 |
| | 15 | 0.15 | 0.135 | 0.17 | 0.19 |
| Upper portion (Middle of the body) | 20 | 0.15 | 0.15 | 0.145 | 0.14 |
| | 25 | 0.15 | 0.16 | 0.15 | 0.14 |
| | 30 | 0.15 | 0.145 | 0.12 | 0.12 |
| | 35 | 0.15 | 0.145 | 0.12 | 0.115 |
| Upper portion (adjacent to the top) | 40 | 0.15 | 0.15 | 0.13 | 0.12 |
| | 50 | 0.15 | 0.16 | 0.14 | 0.13 |
| | 60 | 0.15 | 0.17 | 0.17 | 0.16 |

Table 1 shows the various thickness profiles for a body 5 having a height H of about 64 mm with the height h1 of the lower portion 32 being about 19 mm. The average thickness (of about 0.15 mm) of the four cups that were tested is equal.

During testing, a top load was applied to each cup until the cup ruptured. The portion of the cup that ruptured during the test is shown in Table 2.

TABLE 2

| | Test Parameter | | | |
|---|---|---|---|---|
| | Cup 1 | Cup 2 | Cup 3 | Cup 4 |
| Rupture Location | Lower Portion | Lower Portion | Upper Portion | Upper Portion |

Cups with thickness profiles according to cups 1 and 2 exhibited ruptures in the lower portion 32 of the cup. As it is more difficult to strengthen the lower portion 32 of a thin side wall 5*a* by use of a decorative strip St, it is advantageous to provide a thickness profile with an increase of thickness toward the bottom 6 as in cups 3 and 4 for instance. With such an arrangement, mass distribution in the lower portion 32 is sufficient to prevent a deformation of the body 5 (especially when covered by a conventional strip St) in response to a top load.

In some embodiments, the mass distribution of the cup may be a factor in optimizing the cup strength. The lower portion 32 and bottom 6 of cups 3 and 4 comprised between about 30% and about 40% of the total cup mass. The lower portion 32 and bottom 6 of cups 1 and 2 comprised less than about 30% of the total cup mass.

The wall thickness of the upper portion 30 in the middle part of the body 5 is not more than 160 μm in some embodiments and not more than 150 μm in some embodiments as illustrated by the characteristics of cups 3 and 4. The intermediate thickness at the junction 37 between the lower portion 32 and the upper portion 30 is constant in all the cups tested (the intermediate thickness being of about 0.15 mm). Typically, the part of the upper portion 32 adjacent to the top 7 has a height that may represent about 30% or less of the height H. The middle part (middle of the body 5) has a height that may represent about 50% in some embodiments and less than 60% of the height H in some embodiments.

As shown in Table 3 below, the average thickness of the lower portion 32 is more than the average thickness of the upper portion 30 of cups 3 and 4. Average thickness is to be understood in a known manner with the usual definition (arithmetic mean) and the average thicknesses are typically obtained with a correct precision, i.e. based on at least four measured values at regularly spaced axial positions. The side wall 5*a* in an embodiment has an average thickness lower than 0.3 mm and higher than 0.1 mm. The thicknesses of cups 3 and 4 increases toward the bottom 6, the maximum of increase of thickness being provided in the upper area of the lower portion 32 adjacent to the peripheral intersection line 33. Thickness values at the upper end of the lower portion 32 and at the upper end of the upper portion (adjacent to the top 7), not shown in the Table 1 for sake of clarity, have been taken into account to obtain the average thickness of the lower portion and of the upper portion (adjacent to the top), respectively.

TABLE 3

| | Cup 1 Average thickness (mm) | Cup 2 Average thickness (mm) | Cup 3 Average thickness (mm) | Cup 4 Average thickness (mm) |
|---|---|---|---|---|
| Lower portion | 0.15 | 0.14 | 0.18 | 0.20 |
| Upper portion (Middle of the body) | 0.15 | 0.16 | 0.14 | 0.13 |

TABLE 3-continued

| | Cup 1 Average thickness (mm) | Cup 2 Average thickness (mm) | Cup 3 Average thickness (mm) | Cup 4 Average thickness (mm) |
|---|---|---|---|---|
| Upper portion (adjacent to the top) | 0.15 | 0.19 | 0.17 | 0.16 |

In order to optimize the amount of plastic material used in the body 5, the lower portion 32 has a thickness typically less than about 220 μm. Furthermore, the body 5 (without the flange 10) may have a weight less than about 2 g and a height H comprised between 50 mm and 80 mm in some embodiments and between 55 and 70 mm in some embodiments. The ratio between the average thickness of the upper portion 30 and the average thickness of the lower portion 32 may be comprised between 0.5:1 and 0.9:1 in some embodiments and between 0.6:1 and 0.8:1 in some embodiments. Such a ratio more than 0.5:1 may be included in some embodiments when the average thickness of the body 5 is less than or equal to 0.2 mm. Indeed, the body 5 may be unstable when the upper portion 30 has a sheet thickness that decreases in a more pronounced manner than in the cup 4.

Figure 8:
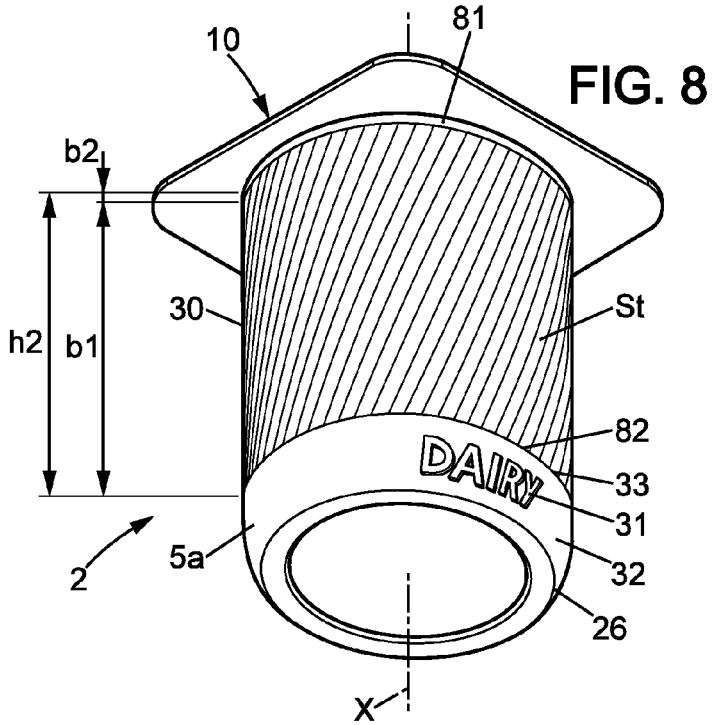
FIG. 8 is a perspective view showing an individual container covered with a decorative strip according to yet another embodiment of the invention.

Referring to FIGS. 1, 2B and 8, the body 5 of some embodiments has a circular section in cross-section and extends symmetrically around the longitudinal axis X. With such a circular section, an operation using a spoon for retrieving the whole content is easier. The lower portion 32 of the side wall 5*a* may also be tapered toward the bottom 6 for the same purpose. A brand name or a similar pattern 31 could be marked in this lower portion 32 when forming the body 5. With this arrangement, the height h2 of the upper portion 30 defining the upper area A for the decorative strip St is advantageously reduced, thus saving packaging material.

Referring to FIG. 8, the body 5 may be covered by any kind of decorative strip St adapted to be shaped according an annular form, and in some embodiments, a cylindrical form. In a similar embodiment the body 5 is partially covered by a sticker.

The container shown in FIG. 8 is provided with a decorative strip St having a height b1 not more than the height h2 of the upper portion 30. An optional small gap may exist between the flange 10 and the upper rectilinear edge 81 of the decorative strip St (being understood that those edges 81, 82 are also rectilinear before fixation onto the upper area A of the upper portion 30). Here the distance b2 from the flange 10 may be about 1-4 mm only. The lower rectilinear edge 82 of the decorative strip St does not extend below the peripheral intersection line 33. In some embodiments, the level of the yoghurt composition or similar food inside the cavity defined by the body 4 is below the opening 8, at a distance greater than the distance b2.

Referring to FIGS. 1, 2B, 3-6 and 8, the upper portion 30 can be seen a cylindrical, thus defining a substantially vertical wall of height h2. Substantially vertical is understood with a tolerance angle of 5° compared to vertical. In the examples shown the upper portion 30 cannot be considered as significantly larger at the top 7 of the body 5 because an angle of less than 2° and for instance of about 1° only is defined with respect to the vertical direction of the longitudinal axis X. This angle is so small than the user will naturally interpret the upper portion 30 as being cylindrical. It can also be appreciated that the outer diameter D of the upper portion 30 can be considered as constant because this angle is typically less than 2° and the height h2 of the upper portion is typically less than 50-60 mm. It will thus be understood that D also represents the outer diameter of the peripheral intersection line 33.

Figure 7:
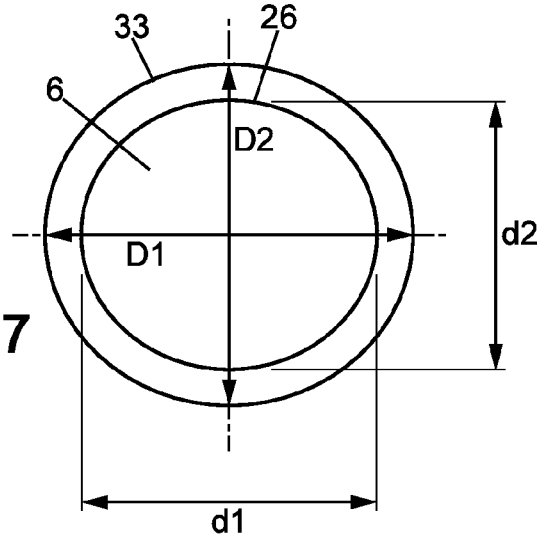
FIG. 7 is a top view of yet another embodiment.

Referring to FIGS. 1, 2A and 7, the side wall 5*a* of the body 5 has a generally circular section in cross-section both in the upper portion 30 and in the lower portion 32. In the upper portion 30, generally circular is understood as encompassing circles and ovals with a ratio D1/D2 very close to 1:1 where D1 is the large dimension in cross section and D2 is the small dimension in cross section as shown in FIG. 7. The following relation is thus satisfied:

$$D1/D2 \leq 1.1$$

In the embodiments shown in FIG. 1, the outer edge 26 of the bottom 6 and the intersection line 33 are strictly circular. When the intersection line 33 is not perfectly circular as shown in FIG. 7, the outer diameter D of the cylindrical upper portion 30 can be calculated by the relation D=(D1+D2)/2. The same applies to the lower portion 32. Similarly, the relation d=(d1+d2)/2 is satisfied, where d is the outer diameter of the bottom 6.

Now referring to FIGS. 2A-2B, the upper portion 30 determines an imaginary tube, here an imaginary cylinder, extending longitudinally around said longitudinal axis X and having the outer diameter D. Because of the curved shape of the tapered lower portion 32. The bottom 6 of the body 5 has a rounded outer edge 26 that is radially spaced apart from the imaginary tube to define a substantially constant radial distance e between the rounded outer edge 26 and the imaginary tube. The curved shape of the lower portion 32 is obtained with a relatively large radius of curvature R so that the radial distance e is significantly less than the half of the diameter d of the bottom 6. Accordingly, the bottom 6 is sufficiently wide to provide a good vertical stability of the container 2 when placed onto a horizontal support. In some embodiments, the following relation $0.8<d/D<0.9$ is satisfied in order to have a stable bottom 6. The ratio e/h1 is comprised between 1/6 and 1/3 and in some embodiments between 1/5 and 3/10 (and in some embodiments less than 0.29). With such a configuration, a slight curvature of the lower portion 32 is obtained and the lower portion 32 provides an additional surface for gripping correctly the container 2. It will be noted that increasing the stretching ratio for the side wall 5*a* is not something easy to perform when having a relatively thin side wall 5*a*, especially in the upper portion 30.

Referring to FIGS. 2A-2B, in order to have good mechanical properties in the lower portion 32 and having a stability of the container 2, the radial distance e may be comprised between 3 and 7 mm. At the intersection between the lower portion 32 and the median virtual plane of the body 5 perpendicular to the bottom 6 (here this median plane corresponds to the plane of the cut view shown in FIG. 2B), a continuously rounded arc is defined with the radius of curvature R significantly higher than the outer diameter d of the bottom 6. Here, the ratio R/h1 is comprised between 2 and 2.8 and in some embodiments between 2 and 2.6.

Figure 4:
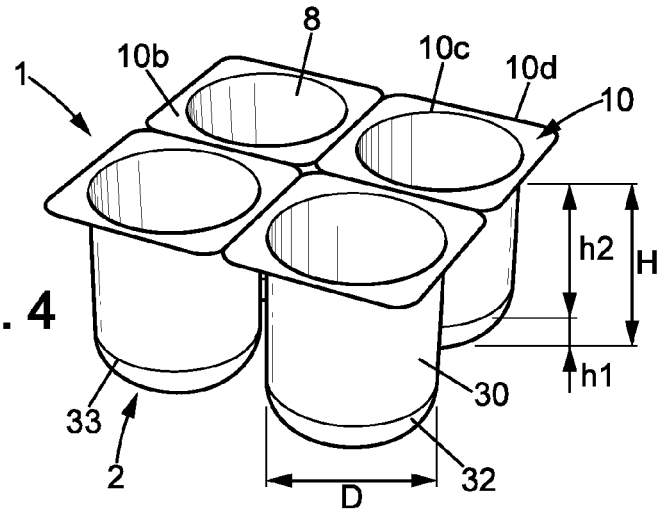
FIG. 4 is a perspective view of a food pack including containers according to yet another embodiment.
Figure 5:
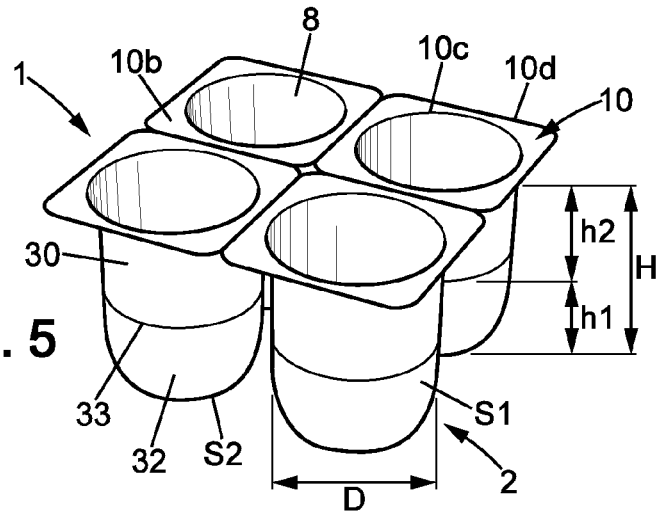
FIG. 5 is a perspective view of a food pack including containers according to yet another embodiment.

Turning to FIGS. 3-5, it can be seen that the height h1 of the lower portion 32 may be slightly adapted. In FIG. 3, the ratio h1/H is about 0.3 and the outer diameter D is slightly higher than the height h2 of the upper portion 30. Turning to FIGS. 3-5, it can be seen that the height h1 of the lower portion 32 may be slightly adapted. In FIG. 4, the ratio h1/H is about 0.16 and the height h2 of the upper portion 30 is slightly higher than the outer diameter D. In this embodiment, the height H of the container 2 is typically at least 65 mm and the height h1 is typically at least equal to 10 mm.

In the embodiment shown in FIG. 5, the ratio h1/H is about 0.4-0.45 and the outer diameter D is slightly higher than the height h2 of the upper portion 30. The lower portion 32 has an outer surface S1 more than twice higher than the outer surface S2 defined by the bottom 6. The ratio S1/S2 is here about 5:2. More generally, the ratio between the first outer surface S1 and the second outer surface S2 may be comprised between 5:2 and 1:1 and in some embodiments between 5:2 and 5:3. For instance, the ratio S1/S2 is about 5:3 for a container 2 as shown in FIG. 3. For a container 2 as shown in FIG. 4, this ratio S1/S2 is lower but more than 1:1.

As apparent in FIGS. 2B and 6, the lower portion 32 may define a circular arc 80 in each median virtual plane that is perpendicular to the bottom 6. This circular arc 80 intersects with the upper portion 30 at the intersection line 33 and intersects with the planar bottom 6 at the outer edge 26. At the intersection line 33, this circular arc 80 of the lower portion 32 may define with the vertical side wall of the upper portion 30 a small angle α comprised between 2° and 10°, as illustrated in FIG. 6. It has been determined that such a non tangent connection of the lower portion 32 with the upper portion 30 is useful in order to increase the radial distance e and the associated transition effect (reduction of the angle at the connection with the bottom 6) without increasing the radius of curvature R of the circular arc 8.

Keeping a relatively large radius of curvature R is here advantageous to maintain a relatively large bottom 6. Indeed, a too high reduction of the dimensions of the bottom 6 would be detrimental to the stability of the container 2. Surprisingly, it has been found that this kind of connection between the upper portion 30 and the lower portion 32 (with an angle and a transition between a straight section and a curved section) does not reduce the overall mechanical properties of the container 2 provided that the thickness is slightly increased in the lower portion 32.

In some variants, it will be understood that the circular arc 80 may be replaced by an arc having a radius of curvature R that slightly decreases near the bottom 6. In such a case, only a lower section of the arc 80 shown in FIG. 6 is modified and the radius of curvature R is constant at least near the peripheral intersection line 33.

Particular embodiments for the flange 10 will be now described referring to FIGS. 1, 3-5, 9 and 11-12.

Figure 9:
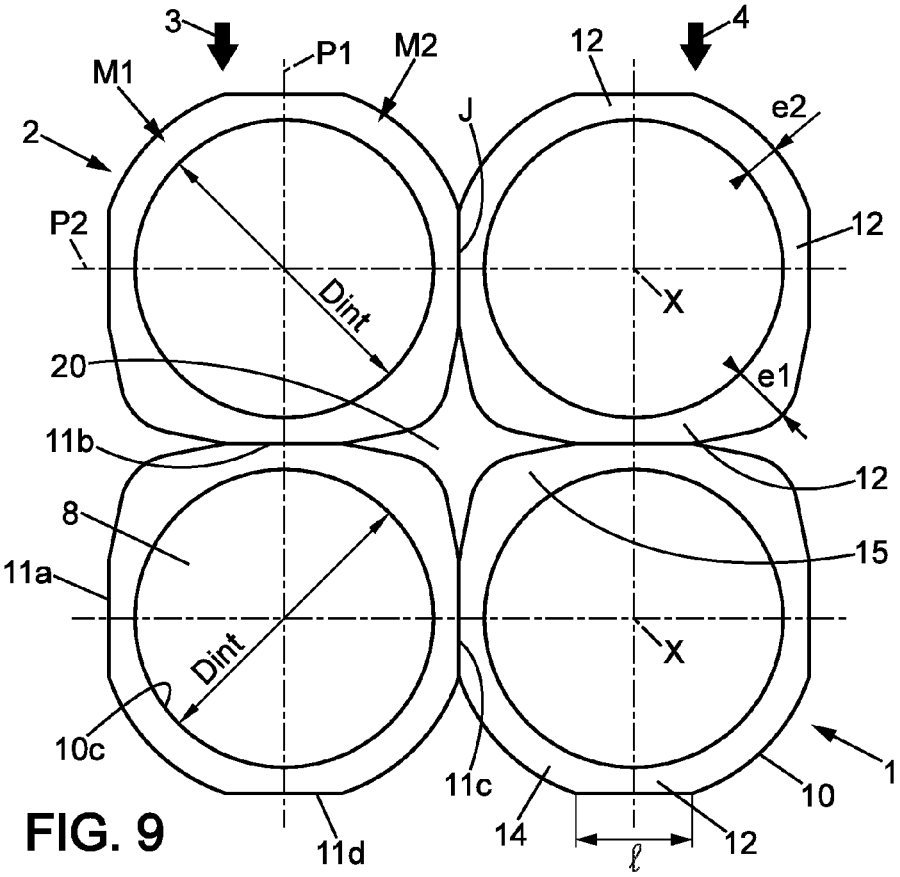
FIG. 9 is a top view of the food pack of FIG. 3.

Referring to FIGS. 1 and 3-5, the flange 10 comprises a lower face 10*a*, an upper face 10*b*, an inner edge 10*c* delimiting the generally circular opening 8 of the container 2. As shown in FIG. 9, the flange 10 is provided with three or four outer straight side edges 11*a*, 11*b*, 11*c*, 11*d*. The outer straight side edges 11*a*, 11*b*, 11*c*, 11*d* are rectilinear edges defined by respective first flange portions 12. In some embodiments, the adhesive for the membrane seal S (FIG. 7) is in contact with the upper face 10*b* at a distance of the inner edge 10*c* and at a distance of the outer straight side edges 11*a*, 11*b*, 11*c*, 11*d*.

In the exemplary embodiment shown in FIG. 9 the first flange portions 12 form the four sides of the flange 10. Four second flange portions 14, 15 are provided to form complementary corner portions relative to the first flange portions 12. Each of the second flange portions 14, 15 thus separates two adjacent first flange portions 12. In the exemplary embodiments shown in the FIGS. 3 and 9, the two adjacent first flange portions 12 extend according perpendicular directions (these directions being of course defined by the corresponding outer straight side edge 11*a*, 11*b*, 11*c*, 11*d*).

In some embodiments, the second flange portions 14, have curved and/or rounded outer side edges, two of which (outer side edges 14*a* as shown in FIG. 11) form circular segments arranged coaxially with the circular opening 8. More generally, the second flange portions 14, 15 each have an outer convex edge obtained by cutting material in corners of a raw plastic rectangular matrix. Each of the outer straight side edges 11*a*, 11*b*, 11*c*, 11*d* are shorter than half of the inner diameter $D_{int}$ of the circular opening 8, thus permitting to remove more plastic material in the corners of the matrix. For instance, the ratio $l/D_{int}$ satisfies the relation:

$$l/D_{int}<0.45,$$

where l is length of any one of the first flange portions 12 and $D_{int}$ is the inner diameter of said circular opening 8. The ratio $l/D_{int}$ may also be less than 0.4 in one particular embodiment. With this arrangement, the change of direction between the straight direction defined by the first flange portion 12 and the tangent direction of the adjacent second flange portion 14 or 15 is minimized (at the corresponding end of the first flange portion 12). The soft transition may prevent a sharp protrusion from forming when the flanges 10 are cut. The perimeter of the flange 10 of an individual container 2 is free of serrated surfaces in one embodiment.

It will be appreciated that with reduction of the size of outer straight side edges 11*a*, 11*b*, 11*c*, 11*d* of the flange 10, a higher reduction of material is obtained in the corners. Surprisingly, the flanged containers 2 can be efficiently connected to one another along their first flange portions 12, without accidental separation, even when using brittle plastic material (for instance polystyrene rather than polyethylene or polypropylene). Outer convex edges longer than the outer straight edges 11*a*, 11*b*, 11*c*, 11*d* make also the flange 10 user-friendly and easy to manipulate when removing the membrane seal S.

Referring to the embodiment shown in FIG. 11, the container 2 is cut from a squared matrix made of polystyrene or similar thermoplastic material. Accordingly, the four outer straight side edges 11*a*, 11*b*, 11*c*, 11*d* define a virtual square 16, each of the outer straight side edges 11*a*, 11*b*, 11*c*, 11*d* having the same length l. As shown in FIG. 11, this length l may be equal to about one third of the length L of one side of the virtual square 16 (i.e. one third of the side of the squared matrix). Although the same length l is shown in FIG. 11, it should be comprised that this length may vary depending on the sides of the flange 10. For instance, one of the outer straight side edges may be a bit shorter or longer than one or more of the other outer straight side edges.

Referring to FIGS. 9 and 11, the flange 10 may extend around the longitudinal axis X with such a geometrical shape that this longitudinal axis X forms an intersection between:

- a first median plane P1 dividing the flange 10 into two symmetrical halves; and
- a second median plane P2 perpendicular to the first median plane P1 and dividing the flange 10 into a first C-shaped portion 17*a* and a second C-shaped portion 17*b*.

The second C-shaped portion 17*b* as shown in the left part of the FIG. 11 comprises the two second flange portions 14 that form circular segments. The first C-shaped portion 17*b* as shown in the right part of the FIG. 11 comprises the two other second flange portions 15. As the radial extension of these second flange portions 15 is higher, they are especially adapted for manual removal of the membrane seal S. The second C-shaped portion 17*b* is thus of lighter weight than the first C-shaped portion 17*a*. In one embodiment of the flange 10, the first and second median planes P1, P2 could be not perpendicular (forming for instance an angle of about 45°).

In one non-limitative embodiment, the ratio between the maximal radial extension e1 of the first C-shaped portion 17*a* and the inner diameter $D_{int}$ of the circular opening 8 is comprised between 0.18 and 0.22, while the ratio between the maximal radial extension e2 of the second C-shaped portion 17*b* and the inner diameter $D_{int}$ is comprised between 0.15 and 0.18. Accordingly, the radial extension of the flange 10 remains much lower than one quarter of the inner diameter $D_{int}$, thus allowing saving much more plastic material. More generally, the second flange portions 14, 15 have a maximal radial extension longer than the radial extension of the first flange portions 12. With the maximal radial extension e1 provided at the second flange portion 15, the corresponding angle is well adapted for a handling and an adequate pulling of the membrane seal S by the user's hand. As shown in the non-limitative example of FIGS. 5A-5B, the first C-shaped portion 17*a* allows a better/faster manipulation by the user (left-handed or right-handed user) because two similar or identical second flange portions 15 are provided with such a maximal radial extension e1.

In one alternative embodiment, three of the second flange portions could be rounded to form circular segments, so as to remove more plastic material. In such a case, only one of the second flange portions has a higher maximal radial extension e2, with the same shape as in the ends of the first C-shaped portion 17*a*.

Figure 13:
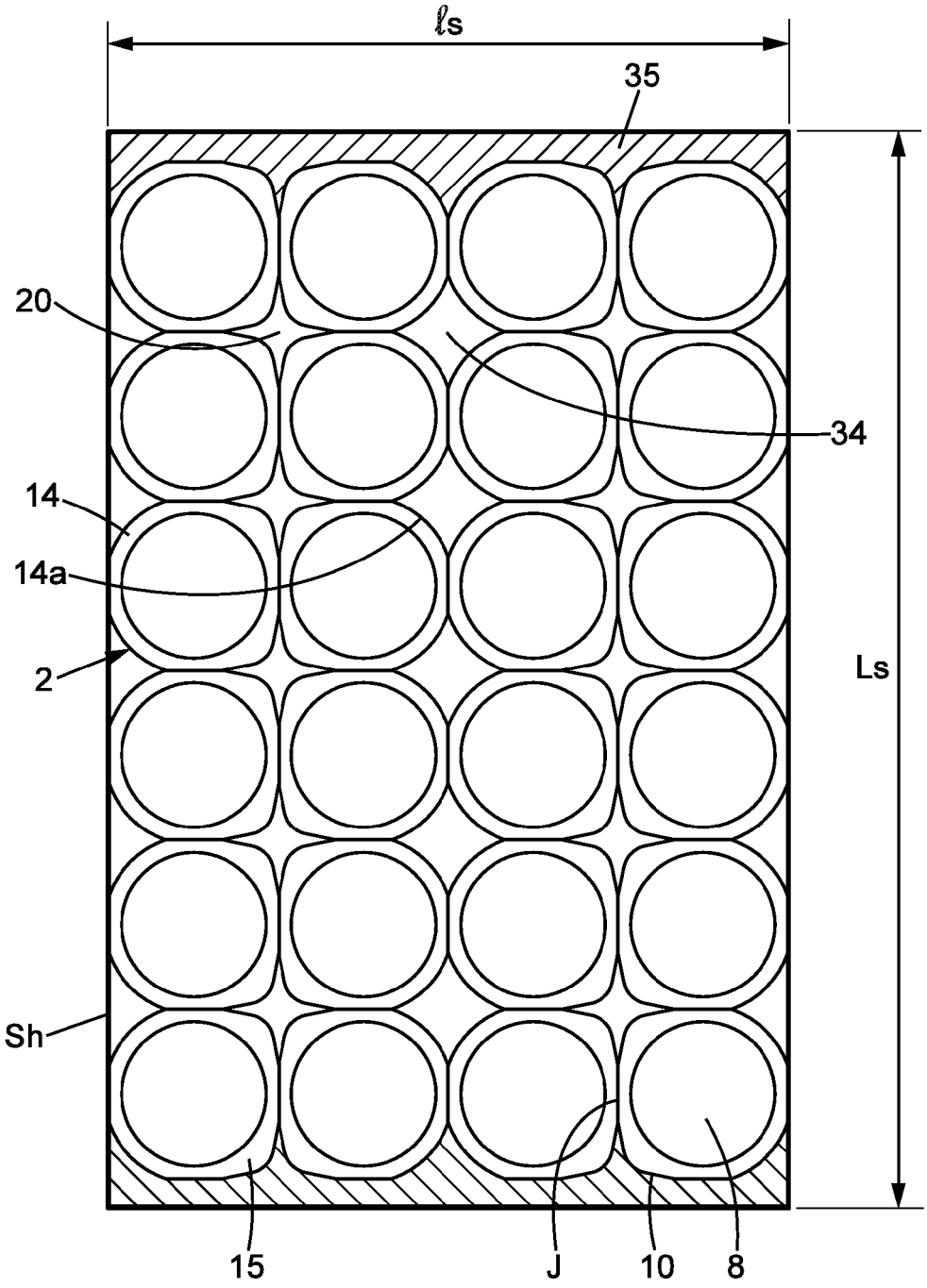
FIG. 13 is a top view of a plastic sheet showing the cut suitable for obtaining a plurality of containers according to an embodiment.

With such a flange 10 provided with the circular opening 8 and distinct C-shaped portion 17*a*-17*b*, a good compromise is obtained between savings of material, size of the diameter $D_{int}$ for an easy access to the content, and facility to remove the membrane seal S. Furthermore, with a short junction J (as shown in FIGS. 9 and 13 in particular), the containers 2 can be separated without forming any sharp corner or hook in the corners, large curved edges being defined by the second flange portions 14 and 15. In some embodiments, the angle defined between the direction defined by one of the outer straight side edges and the tangent direction of the adjacent second flange portion 15 of the first C-shaped portion 17*b* is about 10° and not more than 15°.

It should be also noted that the radial extension of the flange 10 is not a parameter easily reduced, at least because essential functions of the flanges 10 in a pack 1 include:

- increasing strength for supporting a compression load; and
- preventing a contact between the container bodies 5 to occur, in particular when the containers 2 are transported in a stackable tray T as shown in FIG. 4.

As shown in FIG. 10, when arranged in a tray T, each pack 1 of the containers 2 is arranged inside the interior volume V defined by the tray T. The side walls 18 of the tray T may have a height h equal or slightly more than the height H of the containers 2. The side walls 18 are in contact with some of the outer straight side edges 11*a*, 11*bc* 11*c*, 11*d* of the pack 1. As shown in FIG. 1, the other outer straight side edges 11*a*, 11*bc* 11*c*, 11*d* may be each arranged adjacent to one end of a star-cut pattern 20 when the pack 1 comprises at least two rows 3,4.

As shown in FIG. 9, the containers 2 are separably joined to each other at a junction J of two first flange portions 12 of two distinct containers 2 of the pack 1. Here, the second flange portions 14 that are rounded define external portions of the pack 1. These second flange portions 14 define corners that do not have straight edges or sharp corners. In the pack 1 shown in FIG. 1, the star star-cut pattern 20*a* is defined between four containers 2 of a group of containers arranged in as squared manner. The star-cut pattern 20 is thus defined by four edges.

Figure 12:
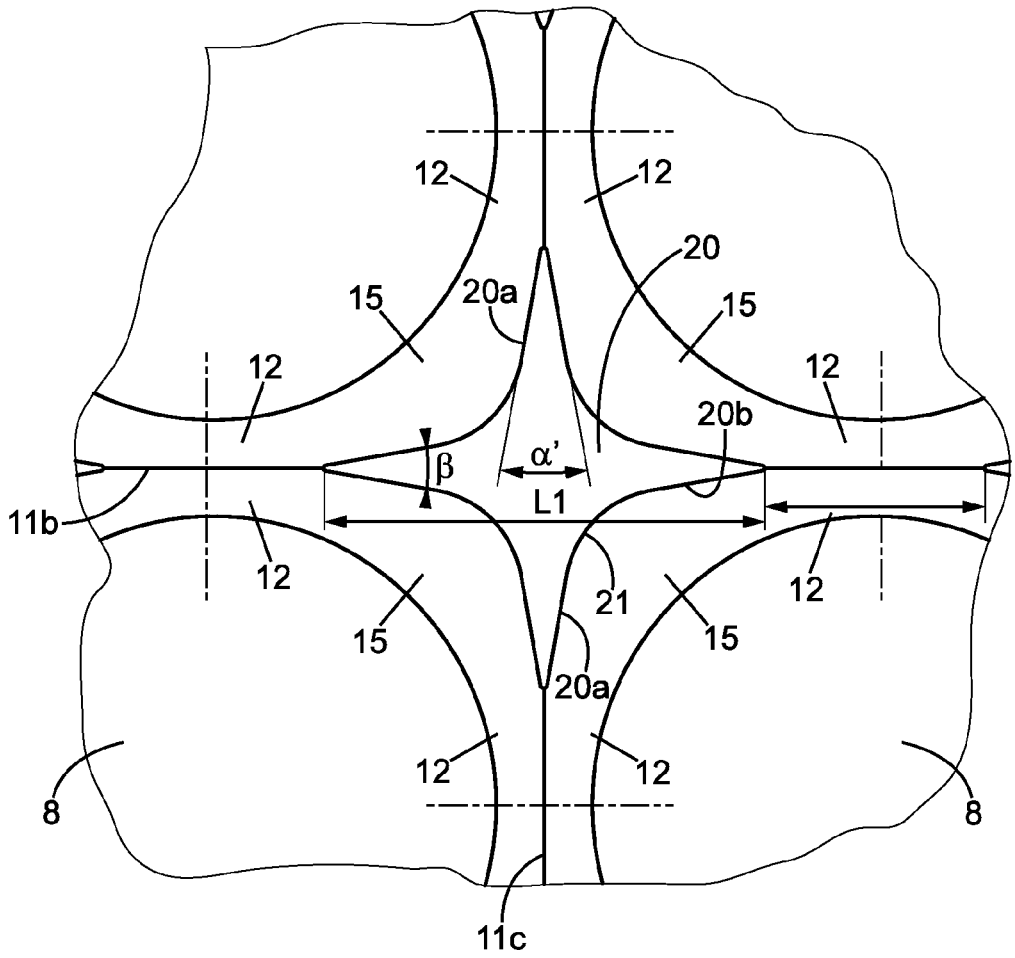
FIG. 12 is a close-up view of the embodiment shown in FIG. 9.

Referring to FIG. 12, each of these edges comprises a curved edge portion 21 extending between two straight edges 20*a*, 20*b*. The respective ends of the corresponding second flange portion 15 form the straight edges 20*a*, 20*b*. The angle α' defined between two adjacent straight edges 20*a* is here comprised between, 15 and 30°, and in some embodiments, equal to about 20°. The angle β defined between the two other adjacent straight edges 20*b* is also comprised between, 15 and 30°, and in some embodiments equal to about 20°. Here, the angle α' and the angle β are the same but in one alternative embodiment, the flange 10 could be asymmetrically shaped. For instance, the flange 10 could have one of the second flange portions 15 provided with a more rounded edge 20*b*, such that the angle β is more than the angle α'.

As shown in FIGS. 9 and 12, the star-cut pattern 20 between the individual containers 2 may have a length L1 much more than the length l of the outer straight side edges 11*a*, 11*b*, 11*c*, 11*d*. Referring to FIG. 1, the thickness E of the flange 10 may be constant and such thickness E is for example not decreased at the junctions J. In some embodiments, the following relation is satisfied:

$$0.75 \leq L1/D_{int} \leq 0.95$$

With such a configuration and a sufficient thickness E at the junctions J, the containers 2 of a pack 1 cannot be accidentally separated. Furthermore, two and in some embodiments, all the second flange portions 14, 15 may each define an external perimeter portion corresponding to at least 1/7 of the external perimeter defined by the flange 10. In some embodiments, for an individual container 2 separated from a four containers pack 1 as shown in FIG. 1, the two outer straight side edges 11*b*, 11C that are obtained after a tearing at the corresponding junctions J represent one fifth or less of the outer perimeter of the flange 10.

The containers 2 are intended to be filled with a liquid or semi-liquid dairy product or similar food, in some embodiments a yoghurt composition. The containers 2 can be used for 50-500 g capacity, and in some embodiments a 75-200 g capacity. Of course, the containers 2 of the present invention are not in any way limited to yoghurt but can be intended to contain all sorts of liquid, semi-liquid or flowable edible products. A container 2 adapted to receive 125 g of a yoghurt composition or similar may be provided with a flange 10 having a diameter of the circular opening equal to about 53-54 mm, while the length L of the flange 10 (i.e. the distance between two parallel outer straight side edges) is equal to about 63 mm and the height H of the container 2 may be comprised between 50 and 80 mm, for instance equal to about 66-67 mm. The length l of each of the four outer straight side edges 11*a*, 11*b*, 11*c*, 11*d* may be equal to about 25 or 21 mm or less.

Referring to the non-limitative embodiment of FIG. 13, a group of twenty-four containers 2 is obtained, starting from a rectangular sheet Sh having a length Ls equal or slightly higher than 6*L (L being length of the squared matrix for each individual container 2) and a width is substantially equal to 4*L. The thickness of the sheet Sh is the same as the thickness E of the flanges 10. Of course, margins 35 of the sheet Sh may be reduced if desired. Such margins 35 are required for maintaining the sheet Sh in a determined position.

Before the cut, the sheet Sh may be punched to form the body cavities that are filled with the food (typically a dairy product composition). The cut is performed after closing the cavities using a foil that is suitable for food contact.

In this example, the surfaces cut according to the star-cut pattern 20 represent about 3-4% and in some embodiments about 3,3% of the whole surface of the sheet Sh. The surfaces 34 cut to delimit the outer side edges 14*a* represent between 5 and 7% of the whole surface of the sheet Sh, in some embodiments 6%. Accordingly, the useful surface of the sheet Sh for producing the twenty-four containers 2 may be less than 90% and in some embodiments less than 85% of the whole surface of the plastic sheet Sh (including margins 35 that represent less than 8%, and in some embodiments less that 7% of the whole surface). Containers 2 shown in FIGS. 1-6 may be obtained by using such a sheet Sh. As a result, 10% or respectively 15% of plastic material can be saved and used for an improved recycling. Density of the plastic sheet Sh before forming operation is in some embodiments less than 0.9, for instance about 0.85 for polystyrene.

The present invention has been described in connection with the embodiments. These embodiments, however, are merely for example and the invention is not restricted thereto. For instance, the flanges 10 shown in FIGS. 1 and 3 can be used in the containers 2 shown in FIGS. 4-5. It will be understood by those skilled in the art that other variations and modifications can easily be made within the scope of the invention as defined by the appended claims, thus it is only intended that the present invention be limited by the following claims.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A container for a food composition, comprising:

a thermoplastic hollow body comprising a generally planar bottom and a side wall extending along a longitudinal axis from said bottom as far as a top, and a generally planar annular flange integral with the body and connected to the top of the body, the flange comprising an inner edge defining a generally circular upper opening of the container, wherein:

the side wall of the body has a generally cylindrical upper portion having a height h2, that comprises the top of the body and a lower portion having a height h1, tapering from the upper portion toward the bottom, the upper portion and the lower portion intersecting and interconnecting at a peripheral intersection line, the container has a height H defined between the planar bottom and the flange, the peripheral intersection line is spaced and at a substantially constant distance from the planar bottom, the lower portion having a height h1 corresponding to less than half of the height H of the container, and the side wall has a thickness profile such that the average thickness of the lower portion is more than the average thickness of the upper portion, and wherein the planar bottom has an outer edge provided with a circular shape and having a diameter, the two following relations being satisfied:

$$0.2 \leq h1/H \leq 0.32$$

$$0.78 \leq d/D \leq 0.9$$

where d is the diameter of the outer edge of the planar bottom and D is an outer diameter of the intersection line.

2. The container according to claim 1, wherein the upper portion of the body has a determined wall thickness of less than 280 μm substantially in the middle of the body, the lower portion having a wall thickness more than said determined wail thickness.

3. The container according to claim 1, wherein the body has a circular section in cross-section and extends symmetrically around said longitudinal axis, the bottom having a periphery of circular shape.

4. The container according to claim 1, wherein in a median virtual plane that is perpendicular to the bottom, an angle comprised between 2° and 10° is formed at the intersection line between the lower portion and the upper portion.

5. The container according to claim 1, wherein the upper portion of the side wall is covered by a decorative strip having a height not more than the height h2 of the upper portion.

6. The container according to claim 1, wherein the lower portion is provided with a mark that is formed when forming the body.

7. The container of claim 1, containing a dairy product.

8. The container of claim 7, wherein the dairy product is a yoghurt composition having a weight not less than 50 g and not more than 500 g.

9. A container for a food composition, comprising:

a thermoplastic hollow body comprising a generally planar bottom and a side wall extending along a longitudinal axis from said bottom as far as a top, and a generally planar annular flange integral with the body and connected to the top of the body, the flange comprising an inner edge defining a generally circular upper opening of the container, wherein:

the side wall of the body has a generally cylindrical upper portion having a height h2, that comprises the top of the body and a lower portion having a height h1, tapering from the upper portion toward the bottom, the upper portion and the lower portion intersecting and interconnecting at a peripheral intersection line, the container has a height H defined between the planar bottom and the flange, the peripheral intersection line is spaced and at a substantially constant distance from the planar bottom, the lower portion having a height h1 corresponding to less than half of the height H of the container, and the side wall has a thickness profile such that the average thickness of the lower portion is more than the average thickness of the upper portion, and wherein at an intersection between the lower portion and a median virtual plane of the body perpendicular to the bottom, a rounded arc is defined with a radius of curvature R, the height h1 of the lower portion being such that the ratio R/h1 is comprised between 2 and 2.8.

10. The container according to claim 9, wherein the upper portion of the body has a determined wall thickness of less than 280 μm substantially in the middle of the body, the lower portion having a wall thickness more than said determined wall thickness.

11. The container according to claim 9, wherein the body has a circular section in cross-section and extends symmetrically around said longitudinal axis, the bottom having a periphery of circular shape.

12. The container according to claim 9, wherein in a median virtual plane that is perpendicular to the bottom, an angle comprised between 2° and 10° is formed at the intersection line between the lower portion and the upper portion.

13. The container according to claim 9, wherein the upper portion of the side wail is covered by a decorative strip having a height not more than the height h2 of the upper portion.

14. The container according to claim 9, wherein the lower portion is provided with a mark that is formed when forming the body.

15. The container of claim 9, containing a dairy product.

16. The container of claim 15, wherein the dairy product is a yoghurt composition having a weight not less than 50 g and not more than 500 g.

17. A container for a food composition, comprising:

a thermoplastic hollow body comprising a generally planar bottom and a side wall extending along a longitudinal axis from said bottom as far as a top, and a generally planar annular flange integral with the body and connected to the top of the body, the flange comprising an inner edge defining a generally circular upper opening of the container, wherein:

the side wall of the body has a generally cylindrical upper portion having a height h2, that comprises the top of the body and a lower portion having a height h1, tapering from the upper portion toward the bottom, the upper portion and the lower portion intersecting and interconnecting at a peripheral intersection line, the container has a height H defined between the planar bottom and the flange, the peripheral intersection line is spaced and at a substantially constant distance from the planar bottom, the lower portion having a height h1 corresponding to less than half of the height H of the container, and the side wall has a thickness profile such that the average thickness of the lower portion is more than the average thickness of the upper portion, wherein the upper portion of the body has a determined wall thickness of less than 280 μm substantially in the middle of the body, the lower portion haying a wall thickness more than said determined wall thickness, and wherein the lower portion has a thickness comprised between 150 and 300 μm.

18. The container according to claim 17, wherein the height h2 of said upper portion is constant, the ratio h2/H being comprised between 3:5 and 6:7.

19. The container of claim 17, wherein the height h2 of said upper portion is constant and the ratio h2/H is comprised between 2:3 and 4:5.

20. The container of claim 19, wherein the ratio h2/H is less than or equal to 3:4.

21. The container according to claim 17, wherein the upper portion of the body has a determined wall thickness of less than 280 μm substantially in the middle of the body, the lower portion having a wall thickness more than said determined wall thickness.

22. The container of claim 17, wherein the body has a circular section in cross-section and extends symmetrically around said longitudinal axis, the bottom haying a periphery of circular shape.

23. The container according to claim 17, wherein the lower portion defines a first outer surface of the body and the bottom defines a second outer surface of the body, the ratio between the first outer surface and the second outer surface being comprised between 5:2 and 5:3.

24. The container according to claim 17, wherein the upper portion of the body determines an imaginary tube extending longitudinally around said longitudinal axis, wherein the bottom has a rounded outer edge that is radially spaced apart from the imaginary tube to define a substantially constant radial distance e between said rounded outer edge and the imaginary tube, and wherein the height h1 of the lower portion is such that the ratio e/h1 is comprised between 1/6 and 1/3.

25. The container according to claim 24, wherein the ratio e/h1 is comprised between 1/5 and 3/10.

26. The container according to claim 17, wherein in a median virtual plane that is perpendicular to the bottom, an angle comprised between 2° and 10° is formed at the intersection line between the lower portion and the upper portion.

27. The container according to claim 17, wherein the upper portion of the side wall is covered by a decorative strip having a height not more than the height h2 of the upper portion.

28. The container according to claim 17, wherein the lower portion is provided with a mark that is formed when forming the body.

29. The container of claim 17, containing a dairy product.

30. The container of claim 29, wherein the dairy product is a yoghurt composition having a weight not less than 50 g and not more than 500 g.

31. The container of claim 17, wherein the ratio between the height h2 of the upper portion and the inner diameter of the opening is comprised between 1:1.15 and 1.15:1.

32. A container for a food composition, comprising a thermoplastic hollow body comprising a generally planar bottom and a side wall extending along a longitudinal axis from said bottom as far as a top, and a generally planar annular flange integral with the body and connected to the top of the body, the flange comprising an inner edge defining a generally circular upper opening of the container, wherein:

the side wall of the body has a generally cylindrical upper portion haying a height h2, that comprises the top of the body and a lower portion having a height h1, tapering from the upper portion toward the bottom, the upper portion and the lower portion intersecting and interconnecting at a peripheral intersection line, the container has a height H defined between the planar bottom and the flange, the peripheral intersection line is spaced and at a substantially constant distance from the planar bottom, the lower portion haying a height h1 corresponding to less than half of the height H of the container, and the side wall has a thickness profile such that the average thickness of the lower portion is more than the average thickness of the upper portion, wherein the upper portion of the body has a determined wall thickness of less than 280 μm substantially in the middle of the body, the lower portion having a wall thickness more than said determined wall thickness, and wherein the side wall has a thickness profile with an increase of thickness toward the bottom, the lower portion haying a maximum of thickness less than 220 μm, said determined wall thickness of the upper portion being not more than 160 μm substantially in the middle of the body.

33. The container according to claim 32, wherein the height h2 of said upper portion is constant, the ratio h2/H being comprised between 3:5 and 6:7.

34. The container of claim 32, wherein the height h2 of said upper portion is constant and the ratio h2/H is comprised between 2:3 and 4:5.

35. The container of claim 34, wherein the ratio h2/H is less than or equal to 3:4.

36. The container according to claim 32, wherein the upper portion of the body has a determined wall thickness of less than 280 μm substantially in the middle of the body, the lower portion having a wall thickness more than said determined wall thickness.

37. The container of claim 32, wherein the body has a circular section in cross-section and extends symmetrically around said longitudinal axis, the bottom having a periphery of circular shape.

38. The container according to claim 32, wherein the lower portion defines a first outer surface of the body and the bottom defines a second outer surface of the body, the ratio between the first outer surface and the second outer surface being comprised between 5:2 and 5:3.

39. The container according to claim 32, wherein the upper portion of the body determines an imaginary tube extending longitudinally around said longitudinal axis, wherein the bottom has a rounded outer edge that is radially spaced apart from the imaginary tube to define a substantially constant radial distance e between said rounded outer edge and the imaginary tube, and wherein the height h1 of the lower portion is such that the ratio e/h1 is comprised between 1/6 and 1/3.

40. The container according to claim 39, wherein the ratio e/h1 is comprised between 1/5 and 3/10.

41. The container according to claim 32, wherein in a median virtual plane that is perpendicular to the bottom, an angle comprised between 2° and 10° is formed at the intersection line between the lower portion and the upper portion.

42. The container according to claim 32, wherein the upper portion of the side wall is covered by a decorative strip having a height not more than the height h2 of the upper portion.

43. The container according to claim 32, wherein the lower portion is provided with a mark that is formed when forming the body.

44. The container of claim 32, containing a dairy product.

45. The container of claim 44, wherein the dairy product is a yoghurt composition having a weight not less than 50 g and not more than 500 g.

46. The container of claim 32, wherein the ratio between the height h2 of the upper portion and the inner diameter of the opening is comprised between 1:1.15 and 1.15:1.

47. A container for a food composition, comprising:

a thermoplastic hollow body comprising a generally planar bottom and a side wall extending along a longitudinal axis from said bottom as far as a top, and a generally planar annular flange integral with the body and connected to the top of the body, the flange comprising an inner edge defining a generally circular upper opening of the container, wherein:

the side wall of the body as a generally cylindrical upper portion having a height h2, that comprises the top of the body and a lower portion having a height h1, tapering from the upper portion toward the bottom, the upper portion and the lower portion intersecting and interconnecting at a peripheral intersection line, the container has a height H defined between the planar bottom and the flange, the peripheral intersection line is spaced and at a substantially constant distance from the planar bottom, the lower portion having a height h1 corresponding to less than half of the height H of the container, and the side wall has a thickness profile such that the average thickness of the lower portion is more than the average thickness of the upper portion, wherein said generally circular upper opening has an inner diameter which is less than the height H of the container, and wherein the ratio between the height h2 of the upper portion and the inner diameter of the opening is comprised between 1:1.15 and 1.15:1.

48. The container according to claim 47, wherein the upper portion of the body has a determined wall thickness of less than 280 μm substantially in the middle of the body, the lower portion having a wall thickness more than said determined wall thickness.

49. The container according to claim 47, wherein the body has a circular section in cross-section and extends symmetrically around said longitudinal axis, the bottom having a periphery of circular shape.

50. The container according to claim 47, wherein the upper portion of the body determines an imaginary tube extending longitudinally around said longitudinal axis, wherein the bottom has a rounded outer edge that is radially spaced apart from the imaginary tube to define a substantially constant radial distance e between said rounded outer edge and the imaginary tube, and wherein the height h1 of the lower portion is such that the ratio e/h1 is comprised between 1/6 and 1/3.

51. The container according to claim 50, wherein the ratio e/h1 is comprised between 1/5 and 3/10.

52. The container according to claim 47, wherein in a median virtual plane that is perpendicular to the bottom, an angle comprised between 2° and 10° is formed at the intersection line between the lower portion and the upper portion.

53. The container according to claim 47, wherein the upper portion of the side wall is covered by a decorative strip having a height not more than the height h2 of the upper portion.

54. The container according to claim 47, wherein the lower portion is provided with a mark that is formed when forming the body.

55. The container of claim 47, containing a dairy product.

56. The container of claim 55, wherein the dairy product is a yoghurt composition having a weight not less than 50 g and not more than 500 g.

57. A container for a food composition, comprising:

a thermoplastic hollow body comprising a generally planar bottom and a side wall extending along a longitudinal axis from said bottom as far as a top, and a generally planar annular flange integral with the body and connected to the top of the body, the flange comprising outer straight side edges and an inner edge that defines a generally circular upper opening of the container, wherein the side wall of the body has a generally cylindrical upper portion that comprises the top of the body and a lower portion tapering from the upper portion toward the bottom, the upper portion haying a height h2, wherein the side wall of the body has a generally circular section in cross-section both in the upper portion and in the lower portion, wherein the side wall has a thickness profile with an intermediate thickness at a junction between the lower portion and the upper portion, said thickness profile being such that the lower portion has a thickness more than said intermediate thickness, the upper portion haying at a distance from said top a thickness less than said intermediate thickness, and wherein the lower portion has a height h1 not less than 14 mm such that the following relation is satisfied:

$$h1/H<0.4$$

where H is the height of the container.

58. The container of claim 57, wherein the height h2 of said upper portion is constant, the ratio h2/H being comprised between 3:5 and 6:7.

59. The container of claim 57, wherein the height h2 of said upper portion is constant and the ratio h2/H is comprised between 2:3 and 4:5.

60. The container of claim 59, wherein the ratio h2/H is less than or equal to 3:4.

61. The container according to claim 57, wherein the upper portion of body has a determined wall thickness of less than 280 μm substantially in the middle of the body, the lower portion having a wall thickness more than said determined wall thickness.

62. The container of claim 57, wherein the body has a circular section in cross-section and extends symmetrically around said longitudinal axis, the bottom having a periphery of circular shape.

63. The container according to claim 57, wherein the lower portion defines first outer surface of the body and the bottom defines a second outer surface of the body, the ratio between the first outer surface and the second outer surface being comprised between 5:2 and 5:3.

64. The container according to claim 57, wherein the upper portion of the body determines an imaginary tube extending longitudinally around said longitudinal axis, wherein the bottom has a rounded outer edge that is radially spaced apart from the imaginary tube to define a substantially constant radial distance e between said rounded outer edge and the imaginary tube, and wherein the height h1 of the lower portion is such that the ratio e/h1 is comprised between 1/6 and 1/3.

65. The container according to claim 64, wherein the ratio e/h1 is comprised between 1/5 and 3/10.

66. The container according to claim 57, wherein in a median virtual plane that is perpendicular to the bottom, an angle comprised between 2° and 10° is formed at the intersection line between the lower portion and the upper portion.

67. The container according to claim 57, wherein the upper portion of the side wall is covered by a decorative strip having a height not more than the height h2 of the upper portion.

68. The container according to claim 57, wherein the lower portion is provided with a mark that is formed when forming the body.

69. The container of claim 57, containing a dairy product.

70. The container of claim 69, wherein the dairy product is a yoghurt composition having a weight not less than 50 g and not more than 500 g.

71. The container of claim 57, wherein the ratio between the height h2 of the upper portion and the inner diameter of the opening is comprised between 1:1.15 and 1.15:1.

72. A food pack comprising a plurality of containers for a food composition, each of the containers comprising:

a thermoplastic hollow body comprising a generally planar bottom and a side wall extending along a longitudinal axis from said bottom as far as a top, and a generally planar annular flange integral with the body and connected to the top of the body, the flange comprising an inner edge defining a generally circular upper opening of the container, wherein the side wall has a generally cylindrical upper portion that comprises the top of the body and a lower portion tapering from the upper portion toward the bottom, the upper portion and the lower portion intersecting and interconnecting at a peripheral intersection line, the upper portion having a height h2, wherein the side wall the body has a generally circular section in cross-section both in the upper portion and in the lower portion, wherein the side wall has a thickness profile with an intermediate thickness at a junction between the lower portion and the upper portion, said thickness profile being such that the lower portion has a thickness more than said intermediate thickness, the upper portion having at a distance from said top a thickness less than said intermediate thickness, wherein the lower portion has a height h1 not less than 14 mm such that the following relation is satisfies:

$$h1/H<0.4$$

where H is the height of the container, and wherein said containers are arranged in at least one row.

73. The pack according to claim 72, comprising at least four containers arranged in two rows, said flanges of each of said containers of the pack being integrally formed and separably joined to each other at a junction of two flange portions of two distinct containers of the pack.

74. The pack according to claim 72, wherein the flanges have an identical shape in all the containers of the pack.

75. The pack according to claim 72, wherein the upper portion of the body has a determined wall thickness of less than 280 μm substantially in the middle of the body, the lower portion having a wall thickness more than said determined wall thickness.

76. The pack according to claim 72, wherein the body has a circular section in cross-section and extends symmetrically around said longitudinal axis, the bottom having a periphery of circular shape.

77. The pack according to claim 72, wherein the upper portion of the body determines an imaginary tube extending longitudinally around said longitudinal axis, wherein the bottom has a rounded outer edge that is radially spaced apart from the imaginary tube to define a substantially constant radial distance e between said rounded outer edge and the imaginary tube, and wherein the height h1 of the lower portion is such that the ratio e/h1 is comprised between 1/5 and 3/10.

78. The pack according to claim 72, wherein in a median virtual plane that is perpendicular to the bottom, an angle comprised between 2° and 10° is formed at the intersection line between the lower portion and the upper portion.

79. The pack according to claim 72, wherein the upper portion of the side wail is covered by a. decorative strip having a. height not more than the height h2 of the upper portion.

80. The pack according to claim 72, wherein the lower portion is provided with a mark that is formed when forming the body.

81. The pack according to claim 72, wherein at least one the containers contains a dairy product.

82. The pack according to claim 81, wherein the dairy product is a yoghurt composition having a weight not less than 50 g and not more than 500 g.

* * * * *